US008113476B2

(12) United States Patent
Serio

(10) Patent No.: US 8,113,476 B2
(45) Date of Patent: Feb. 14, 2012

(54) HINGED PICTURE HANGER

(75) Inventor: Craig S. Serio, New Berlin, WI (US)

(73) Assignee: Newell Operating Company, Huntersville, NC (US)

( * ) Notice: Subject to any disclaimer, the term of this patent is extended or adjusted under 35 U.S.C. 154(b) by 128 days.

(21) Appl. No.: 12/460,165

(22) Filed: Jul. 14, 2009

(65) Prior Publication Data

US 2011/0012006 A1 Jan. 20, 2011

(51) Int. Cl.
*F16B 45/00* (2006.01)

(52) U.S. Cl. ..... 248/308; 248/301; 248/304; 248/305; 248/306; 248/206.5

(58) Field of Classification Search ..... 248/324, 248/339, 489, 475.1, 493, 301, 304, 305, 248/306, 308, 206.5, 496, 497
See application file for complete search history.

(56) References Cited

U.S. PATENT DOCUMENTS

| | | | | | |
|---|---|---|---|---|---|
| 1,422,128 | A | * | 7/1922 | Hager | 248/306 |
| 1,478,461 | A | * | 12/1923 | Underwood | 248/489 |
| 2,105,345 | A | * | 1/1938 | Card | 248/489 |
| 3,020,013 | A | * | 2/1962 | Ochin et al. | 248/493 |
| 3,023,991 | A | | 3/1962 | Fisher | |
| 3,360,229 | A | | 12/1967 | Beyer | |
| 3,433,449 | A | | 3/1969 | Musante | |
| 3,861,631 | A | * | 1/1975 | Shorin | 248/546 |
| 3,912,211 | A | * | 10/1975 | Topf | 248/489 |
| 3,966,157 | A | * | 6/1976 | Corral et al. | 248/217.3 |
| 4,821,992 | A | * | 4/1989 | Johnson | 248/493 |
| 5,267,719 | A | | 12/1993 | Keller | |
| 5,329,675 | A | * | 7/1994 | McLean et al. | 24/599.6 |
| 5,639,049 | A | | 6/1997 | Jennings et al. | |
| 6,206,334 | B1 | * | 3/2001 | Weck et al. | 248/467 |
| 6,338,463 | B1 | * | 1/2002 | Babitz et al. | 248/317 |
| 6,352,229 | B1 | * | 3/2002 | Adams | 248/316.7 |
| 6,491,271 | B1 | * | 12/2002 | Adams | 248/206.5 |
| 6,651,945 | B2 | * | 11/2003 | Rivellino et al. | 248/206.5 |
| 6,672,551 | B2 | * | 1/2004 | Rivellino et al. | 248/206.5 |
| 7,222,833 | B2 | | 5/2007 | Yang | |
| 2005/0023420 | A1 | * | 2/2005 | Sadeh et al. | 248/206.5 |
| 2005/0109904 | A1 | * | 5/2005 | Diggle et al. | 248/304 |
| 2007/0194187 | A1 | * | 8/2007 | Amron | 248/206.5 |

* cited by examiner

*Primary Examiner* — Nkeisha Smith
(74) *Attorney, Agent, or Firm* — Taft Stettinius & Hollister LLP

(57) ABSTRACT

A hanger for suspending an object from a supporting surface. An exemplary hanger may include a base mountable to a supporting surface, the base including a hook portion providing an upwardly opening gap, and a receiver pivotably mounted adjacent to a distal edge of the hook portion, the receiver being pivotable between an open position in which the receiver and the gap provide an aperture wider than the gap for receiving a supporting device connected to an object and a closed position in which the receiver substantially overlaps the gap. Some exemplary embodiments may include a magnet mounted to the receiver.

14 Claims, 8 Drawing Sheets

HINGED PICTURE HANGER

BACKGROUND

The present disclosure relates generally to devices for supporting objects and, more particularly, to hanging devices for supporting decorative articles.

SUMMARY

In an aspect, a hanger for suspending an object from a supporting surface may include a base mountable to a supporting surface, the base including a hook portion providing an upwardly opening gap; and a receiver pivotably mounted adjacent to a distal edge of the hook portion, the receiver being pivotable between an open position in which the receiver and the gap provide an aperture, wider than the gap for receiving a supporting device connected to an object and a closed position in which the receiver substantially overlaps the gap.

In a detailed embodiment, the hook portion may be integrally formed with the base.

In a detailed embodiment, a hanger may include a hinge interposing the receiver and the distal edge of the hook portion, the hinge may be rigidly affixed to the base, and the receiver may be pivotably coupled to the hinge by a pin. In a detailed embodiment, the hinge may include a ridge which engages a projection extending from the receiver when the receiver is in the open position. In a detailed embodiment, engagement of the ridge and the projection may limit rotation of the receiver relative to the hinge.

In a detailed embodiment, the base may include at least one hole for receiving a fastener therethrough, and the hole may be angled with respect to perpendicular to the base.

In a detailed embodiment, a hanger may include a magnet mounted to the receiver. In a detailed embodiment, the magnet may be positioned on an inner face of the receiver, and the inner face may substantially oppose the gap when the receiver is in the closed position.

In a detailed embodiment, in the closed position, a distal end of the receiver may contact the base. In a detailed embodiment, the hook portion may extend from the base at a first angle; in the open position the receiver may extend relative to the base at a second angle; and the second angle may be greater than the first angle. In a detailed embodiment, a width of the aperture may be at least twice a width of the gap.

In an aspect, a hanger for suspending an object from a supporting surface may include a hook including an upwardly opening gap, the hook being supported from a supporting surface; and a receiver hingedly coupled to a distal edge of the hook, the distal edge of the hook being generally opposite the supporting surface. The receiver may be pivotable between a first position in which the receiver extends generally away from the supporting surface and a second position in which the receiver extends generally towards the supporting surface.

In a detailed embodiment, in the second position, the receiver may substantially overlay the gap.

In a detailed embodiment, a hanger may include a hinge interposing the receiver and the distal end of the hook, the hinge being rigidly coupled to the distal end of the hook and being pivotably coupled to the receiver. In a detailed embodiment, the receiver may be pivotably coupled to the hinge by a pin extending at least partially through the hinge and at least partially through the receiver.

In a detailed embodiment, the receiver may include a projection that engages a ridge on the hinge when the receiver is in the first position, and the engagement of the projection and the ridge may limit movement of the receiver in an opening direction. In a detailed embodiment, a hanger may include a magnet mounted to the receiver. In a detailed embodiment, a hanger may include a base interposing the hook and the supporting surface, and the base may include at least one through hole for receiving a fastener.

In an aspect, a method for suspending an object from a supporting surface may include placing a supporting device of an object proximate an aperture at least partially defined by a receiver, where the receiver is pivotably coupled to a base of a hanger, the hanger being affixed to a supporting surface; placing the supporting device in a hook portion of the base; and pivoting the receiver into a closed position in which the receiver substantially overlaps a gap of the hook.

In a detailed embodiment, a method may include, prior to placing the supporting device proximate the aperture, affixing the base to the supporting surface. In a detailed embodiment, a method may include, prior to placing the supporting device proximate the aperture, pivoting the receiver into an open position in which the receiver and the hook portion provide an aperture wider than the gap of the hook.

In a detailed embodiment, placing the supporting device proximate the aperture may include attracting the supporting device to the receiver using a magnet mounted to the receiver.

BRIEF DESCRIPTION OF THE DRAWINGS

The detailed description refers to the following figures in which.

DETAILED DESCRIPTION

The present disclosure contemplates that some objects, such as picture frames, may be suspended from supporting surfaces, such as a wall, using a hanger mounted to the wall and a wire extending at least partially across the back of the picture frame. Because the hanger is close to the wall and the picture frame may obstruct the view of the wire, it may be difficult to properly engage the wire with the hanger. In addition, the picture frame may contact the wall, causing damage to the picture frame and/or the wall. Exemplary hangers according to the present disclosure may reduce the difficulty of engaging the wire with the hanger without causing damage to the wall or the picture frame.

Figure 1:
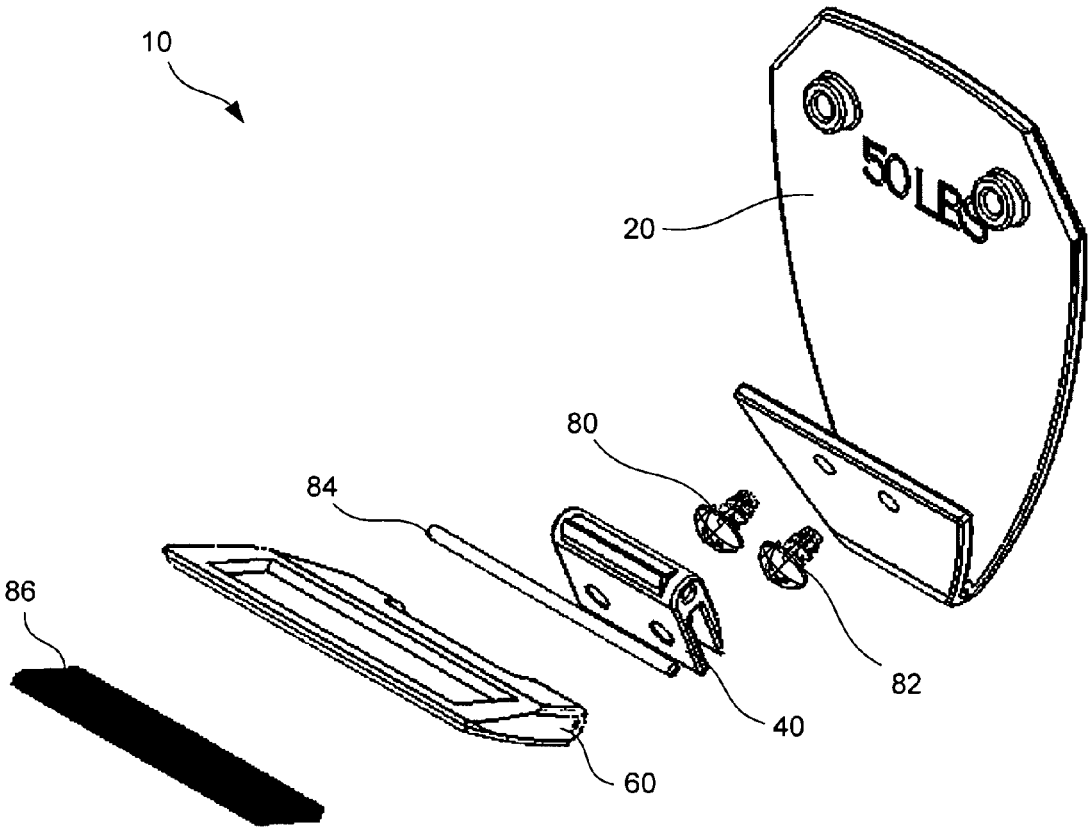
FIG. 1 is an exploded perspective view of an exemplary hanger.

As illustrated in FIG. 1, an exemplary hanger 10 may include a base 20, a hinge 40, and/or a receiver 60. The hinge 40 may be affixed to the base 20 using one or more fasteners, such as screws 80, 82. One or more pins 84 may pivotably couple the receiver 60 and the hinge 40. In some exemplary embodiments, one or more magnets 86 may be mounted to or within receiver 60.

Figure 2:
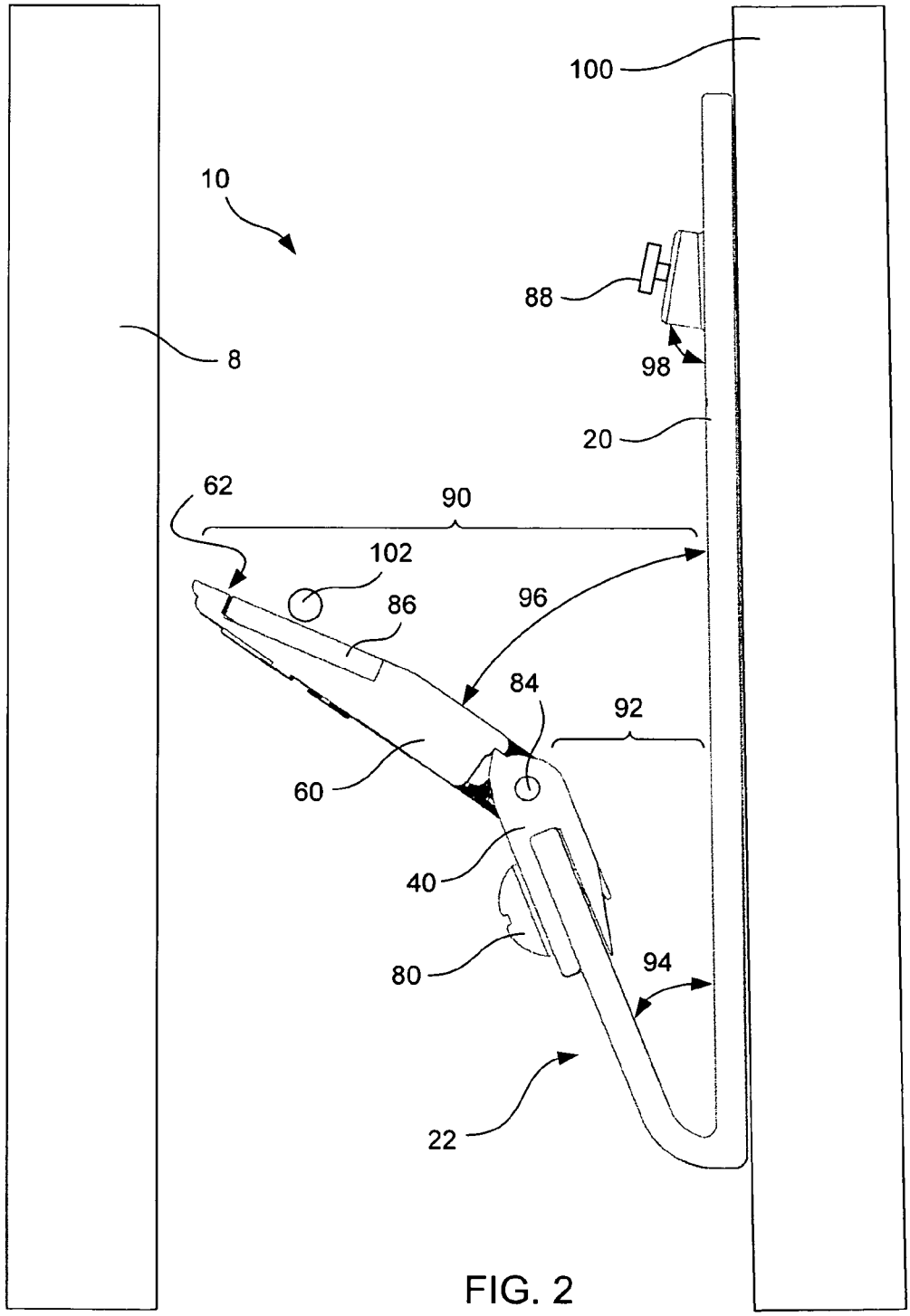
FIG. 2 is a cross-sectional side elevation view of an exemplary hanger in an open position.

Referring to FIG. 2, an exemplary hanger may be mounted to a supporting surface, such as a wall 100, using one or more fasteners, such as nail 88. In some exemplary embodiments, the hanger 10 may be mounted to a supporting surface using other methods known in the art, such as, for example and without limitation, adhesive, one or more magnets, one or more hook-and-loop fasteners, etc. In some exemplary embodiments, the fastener may be oriented at a non-perpendicular angle with respect to base 20. For example, angle 98 may be approximately 100 degrees, which corresponds to approximately a ten degree downward angle of nail 88.

FIG. 2 illustrates the hanger 10 in an open configuration in which an inner side 62 of receiver 60 is substantially exposed. In an open configuration, hanger 10 may receive a connecting device, such as wire 102, which may be attached to an object, such as a picture frame 8. Engagement of the wire 102 and the hanger 10 may be facilitated by the wide aperture 90 presented by the hanger 10 in the open configuration, which may be substantially wider than the gap 92 of the hook portion 22. In an exemplary embodiment, aperture 90 may be approximately 0.9 inches, and gap 92 may be approximately 0.35 inches. In addition, in exemplary embodiments including a magnet 86, a connecting device comprising a magnetic material (e.g., a material that exhibits magnetic properties, such as iron), may be attracted to magnet 86, which may assist in engaging the connecting device with the hanger 10.

In an exemplary embodiment, the angle 94 between the base 20 and the hook portion 22 may be approximately 20 degrees, and the angle 96 between the base 20 and the receiver 60 may be approximately 55 degrees.

Figure 3:
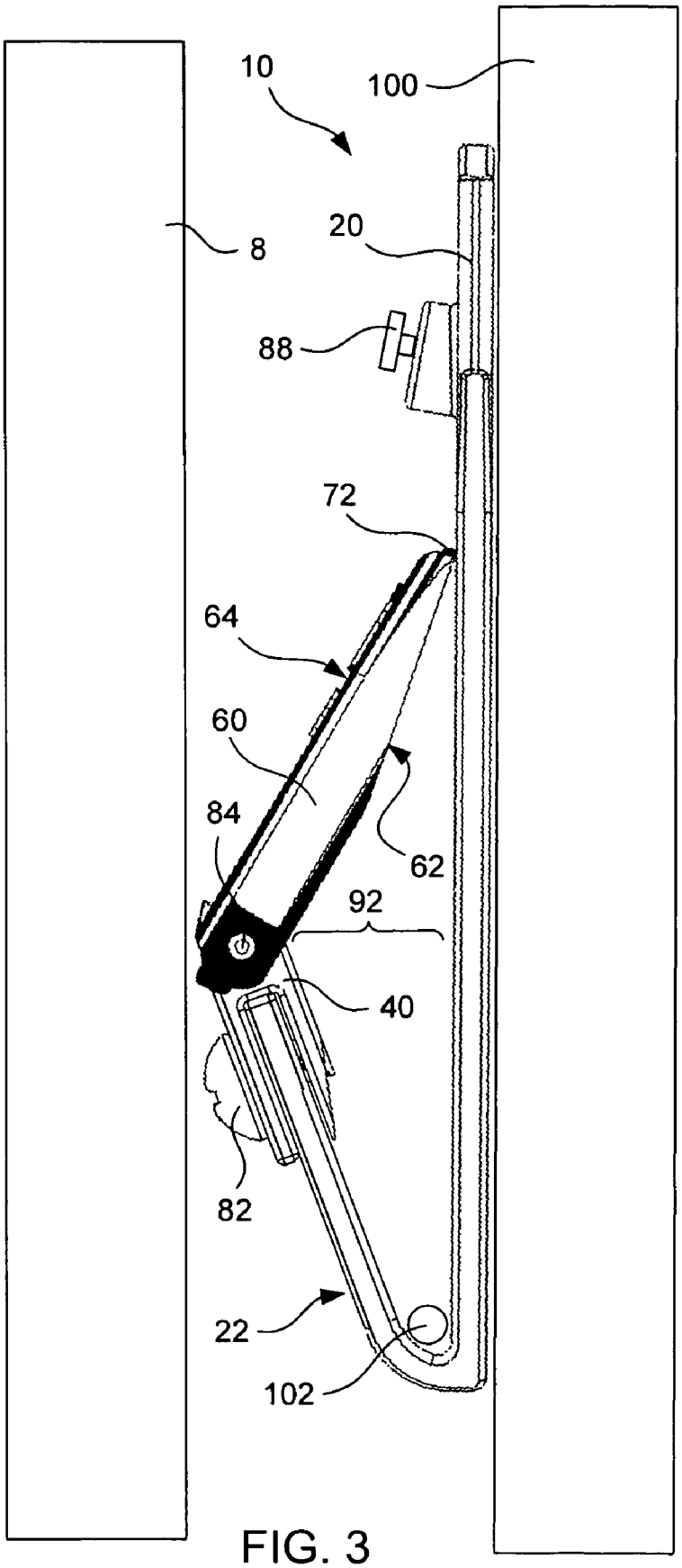
FIG. 3 is a side elevation view of an exemplary hanger in a closed position.

FIG. 3 illustrates an exemplary hanger 10 in a closed configuration. In the closed configuration, an outer surface 64 of the receiver 60 may be substantially exposed and/or the inner surface 62 may be substantially unexposed. The receiver 60 may substantially overlay gap 92 and/or distal end 72 of receiver 60 may contact base 20. Wire 102 may be retained within hook portion 22 of base 20. Because receiver 60 has been pivoted inward, picture frame 8 may be suspended nearer to wall 100 than when hanger 10 is in the open position.

Figure 4:
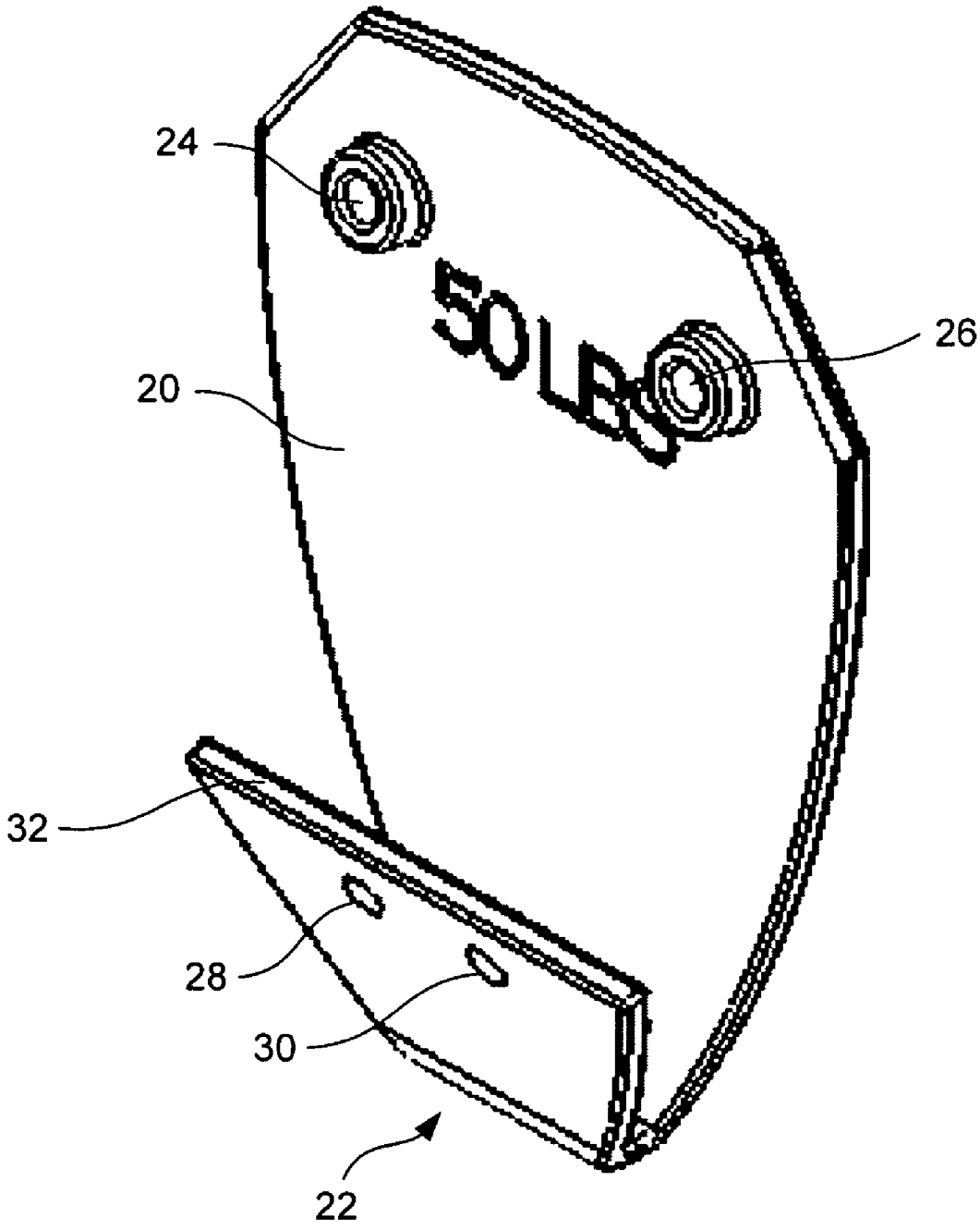
FIG. 4 is a perspective view of an exemplary hanger base.

FIG. 4 illustrates an exemplary base 20, which may include one or more holes 24, 26 for receiving fasteners, such as nail 88. As discussed above, in some exemplary embodiments, holes 24, 26 may be non-perpendicular with base 20. For example, holes 24, 26 may be angled about ten degrees downward with respect to perpendicular to the base 20. The hook portion 22 may terminate in a distal edge 32, which may receive the hinge 40. One or more holes 28, 30 may receive screws 80, 82, which may secure hinge 40 proximate distal edge 32. In an exemplary embodiment, base 20 may be approximately 1.8 inches high, 1.25 inches wide, and the hook portion 22 may be approximately 0.5 inches deep.

Figure 5:
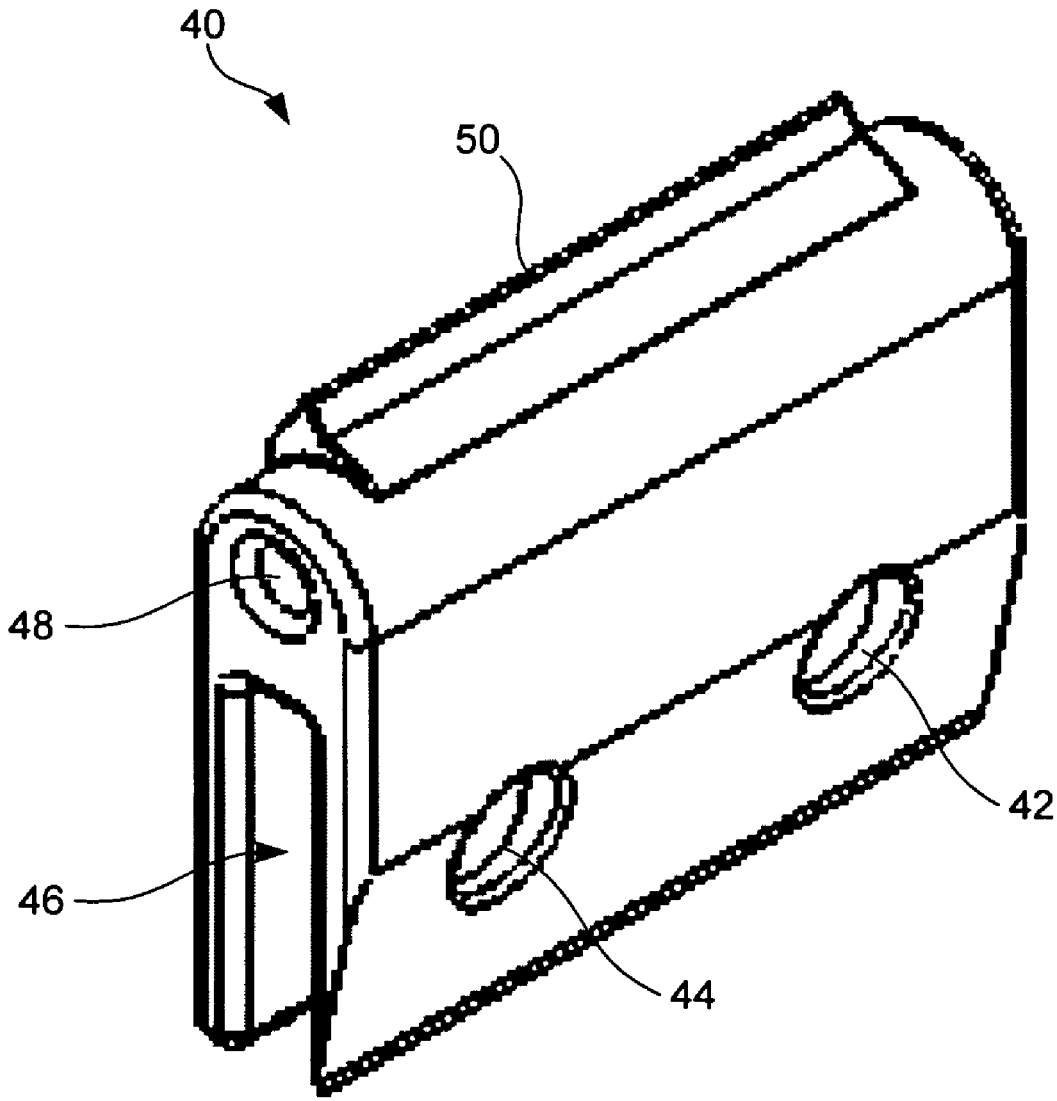
FIG. 5 is a perspective view of an exemplary hinge.
Figure 6:
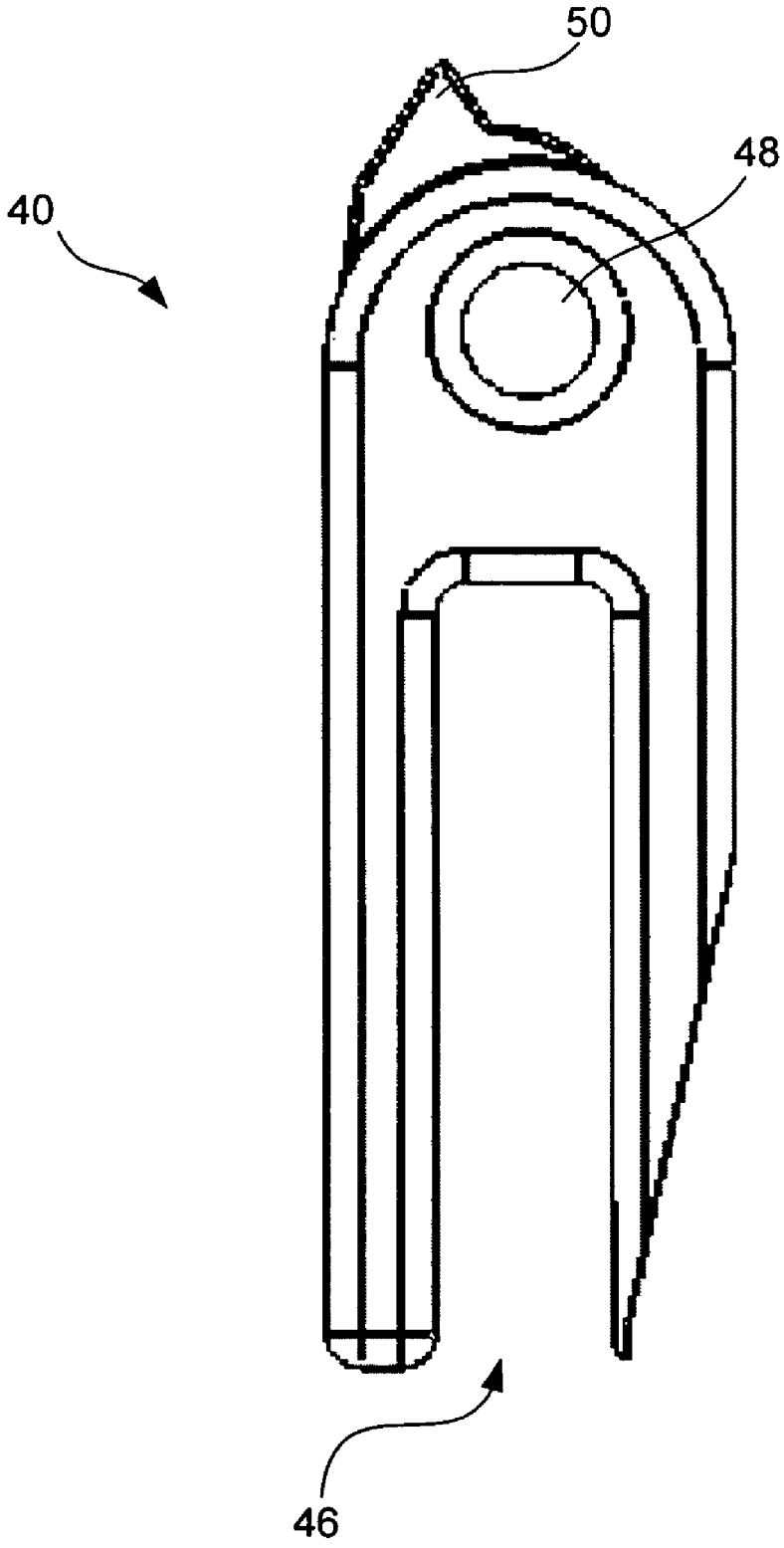
FIG. 6 is a side elevation view of an exemplary hinge.

As shown in FIGS. 5 and 6, an exemplary hinge 40 may include one or more holes 42, 44 for receiving screws 80, 82, respectively, when distal edge 32 of base 20 is received within slot 46. Through hole 48 may receive pin 84 when receiver 60 is assembled to hinge 40. Ridge 50 may cooperate with receiver 60 to limit rotation of the receiver 60 in the opening direction. In an exemplary embodiment, the hinge 40 may be approximately 0.5 inches wide (parallel to through hole 48) and approximately 0.4 inches high.

Figure 7:
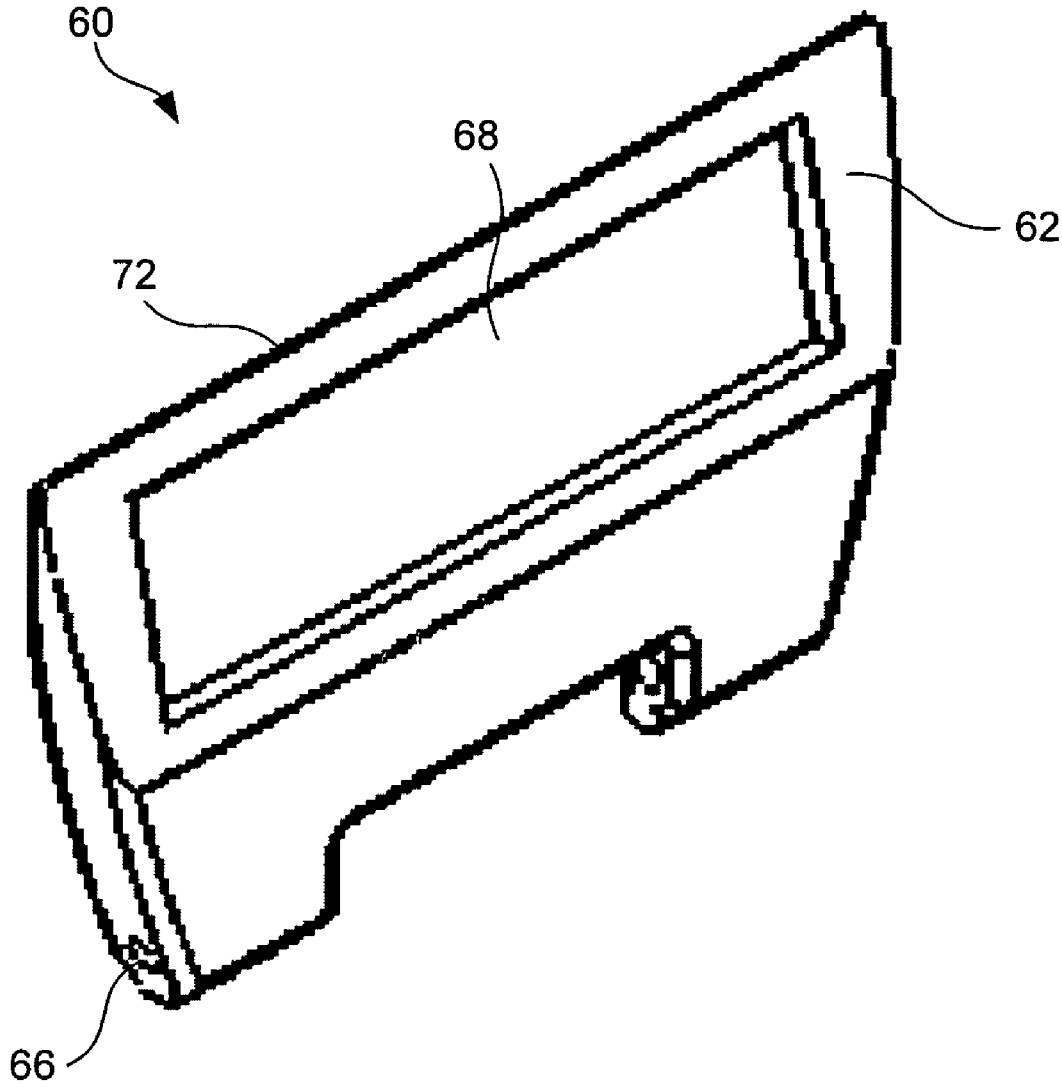
FIG. 7 is a perspective view of an exemplary receiver.
Figure 8:
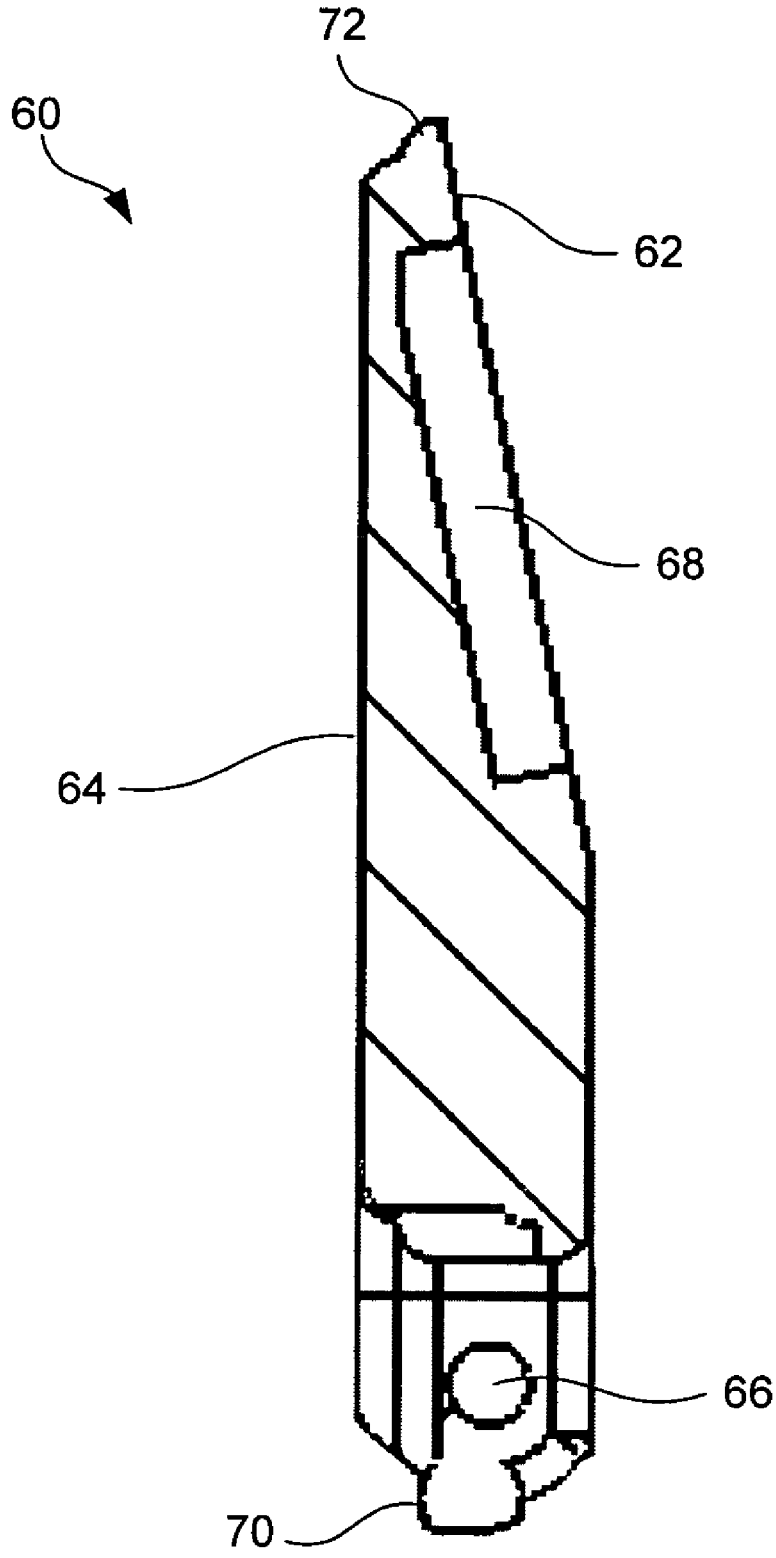
FIG. 8 is a cross-sectional side elevation view of an exemplary receiver; all in accordance with at least some aspects of the present disclosure.

As shown in FIGS. 7 and 8, an exemplary receiver 60 may include a through hole 66 for receiving pin 84 when receiver 60 is mounted to hinge 40. Inner surface 62 may include a recessed portion 68 for receiving magnet 86. One or more projections 70 may be arranged to selectively engage ridge 50 of hinge 40, such that rotation of the receiver in the opening direction may be limited. In an exemplary embodiment, the distance from the distal end 72 to the through hole 66 may be approximately 0.7 inches, and the greatest width of the receiver 60 (parallel to through hole 66) may be approximately 1.25 inches.

In some exemplary embodiments, the base 20 may be constructed from metal, such as sheet steel, and/or plastic. In some exemplary embodiments, the hinge 40 and/or the receiver 60 may be constructed substantially from plastic.

An exemplary hanger 10 may be used as follows. The base 20 may be affixed to a wall 100 using fasteners 88 extending through holes 24, 26. The receiver 60 may be placed in the open position. A picture frame 8 having a wire 102 may be placed in front of the hanger 10 such that the wire 102 is in or near the aperture 90. If the exemplary hanger 10 includes a magnet 86 and if the wire 102 is a magnetic material, the wire 102 may be attracted to the magnet 86 in the receiver 60. With the wire 102 lying within the aperture 90, the receiver 60 may be pivoted to the closed position, and the picture frame 8 may be suspended from the wall 100 by the hanger 10.

While exemplary embodiments have been set forth above for the purpose of disclosure, modifications of the disclosed embodiments as well as other embodiments thereof may occur to those skilled in the art. Accordingly, it is to be understood that the disclosure is not limited to the above precise embodiments and that changes may be made without departing from the scope. Likewise, it is to be understood that it is not necessary to meet any or all of the stated advantages or objects disclosed herein to fall within the scope of the disclosure, since inherent and/or unforeseen advantages may exist even though they may not have been explicitly discussed herein.

What is claimed is:

1. A hanger for suspending an object from a supporting surface, the hanger comprising: a base mountable to a supporting surface, the base including a hook portion providing an upwardly opening gap; and a receiver pivotably mounted adjacent to a distal edge of the hook portion, the receiver being pivotable between an open position in which the receiver and the gap provide an aperture wider than the gap for receiving a supporting device connected to an object and a closed position in which the receiver substantially overlaps the gap, the hanger further comprising a hinge interposing the receiver and the distal edge of the hook portion, wherein the hinge is rigidly affixed to the base, and wherein the receiver is pivotably coupled to the hinge by a pin wherein the hinge includes a ridge which engages a protection extending from the receiver when the receiver is in the open position.

2. The hanger of claim 1, wherein the hook portion is integrally formed with the base.

3. The hanger of claim 1, wherein engagement of the ridge and the projection limits rotation of the receiver relative to the hinge.

4. The hanger of claim 1, wherein the base includes at least one hole for receiving a fastener therethrough; and wherein the at least one hole is angled with respect to perpendicular to the base.

5. The hanger of claim 1, further comprising a magnet mounted to the receiver.

6. The hanger of claim 5, wherein the magnet is positioned on an inner face of the receiver; and wherein the inner face substantially opposes the gap when the receiver is in the closed position.

7. The hanger of claim 1, wherein, in the closed position, a distal end of the receiver contacts the base.

8. The hanger of claim 1, wherein the hook portion extends from the base at a first angle; wherein, in the open position, the receiver extends relative to the base at a second angle; and wherein the second angle is greater than the first angle.

9. The hanger of claim 1, wherein a width of the aperture is at least twice a width of the gap.

10. A hanger for suspending an object from a supporting surface, the hanger comprising: a hook including an upwardly opening gap, the hook being supported from a supporting surface; and a receiver hingedly coupled to a distal edge of the hook, the distal edge of the hook being generally opposite the supporting surface; wherein the receiver is pivotable between a first position in which the receiver extends generally away from the supporting surface and a second position in which the receiver extends generally towards the supporting surface, the hanger further comprising a hinge interposing the receiver and the distal edge of the hook, the hinge being rigidly coupled to the distal edge of the hook and being pivotably coupled to the receiver and wherein the receiver includes a projection that engages a ridge on the hinge when the receiver is in the first position; and wherein the engagement of the projection and the ridge limits movement of the receiver in an opening direction.

11. The hanger of claim 10, wherein, in the second position, the receiver substantially overlays the gap.

12. The hanger of claim 10, wherein the receiver is pivotably coupled to the hinge by a pin extending at least partially through the hinge and at least partially through the receiver.

13. The hanger of claim 10, further comprising a magnet mounted to the receiver.

14. The hanger of claim 10, further comprising a base interposing the hook and the supporting surface; wherein the base includes at least one through hole for receiving a fastener.

* * * * *